United States Patent [19]

Norigoe

[11] Patent Number: 5,056,942

[45] Date of Patent: Oct. 15, 1991

[54] DOT PRINTER HEAD

[75] Inventor: Takashi Norigoe, Shizuoka, Japan

[73] Assignee: Tokyo Electric Co., Ltd., Tokyo, Japan

[21] Appl. No.: 507,404

[22] Filed: Apr. 11, 1990

[30] Foreign Application Priority Data

Apr. 20, 1989 [JP] Japan ..... 1-100967

[51] Int. Cl.[5] ..... B41J 3/10

[52] U.S. Cl. ..... 400/124; 101/43.05

[58] Field of Search ..... 400/124; 101/93.05

[56] References Cited

U.S. PATENT DOCUMENTS 4,737,042 4/1988 Hayashi et al. ..... 400/124
4,812,061 3/1989 Tsuyuki ..... 400/124
4,944,615 7/1990 Kato et al. ..... 101/93.05

FOREIGN PATENT DOCUMENTS 0110662 6/1984 European Pat. Off. .
0141522 5/1985 European Pat. Off. .
0156547 10/1985 European Pat. Off. .
55-90384 7/1980 Japan ..... 101/93.29

*Primary Examiner*—Edgar S. Burr
*Assistant Examiner*—Ren Yan
*Attorney, Agent, or Firm*—Oblon, Spivak, McClelland, Maier & Neustadt

[57] ABSTRACT

According to the present invention, a plurality of cores with electromagnetic coils wound thereon are arranged annularly on one side of a polygonal plate-like yoke; a plurality of armatures with needles connected thereto are opposed to end faces of the cores; there is provided a polygonal, side magnetic path plate which has side magnetic paths each positioned between adjacent such armatures and which holds the armatures so as to permit the armatures to rise and fall; support rod portions coupled magnetically to the corners of the side magnetic path plate are formed on the yoke; and magnetic flux is passed through the support rod portions and the corners of the side magnetic path plate.

3 Claims, 6 Drawing Sheets

DOT PRINTER HEAD

FIELD OF THE INVENTION AND RELATED ART STATEMENT

The present invention relates to an impact type dot printer head using needles.

A conventional example is shown in FIG. 14. As illustrated therein, in a yoke 51 held by a head frame 50 and having an annular circumferential wall 51a, a plurality of cores 53 which hold electromagnetic coils 52 are arranged and integrally formed inside the circumferential wall 51*a*. A yoke plate 54 fixed to the circumferential wall 51*a* of the yoke 51 has a plurality of openings for fitting therein of intermediate and rear end portions of plural armatures 55, and between adjacent such openings there is formed a side magnetic path which is for magnetic coupling between adjacent armatures 55. Needles 57 which are urged in a returning direction by springs 56 are in abutment with the inner ends of the armatures 55. The needles 57 are held slidably by guide portions 58, 59 and 60 of the head frame 50. Further, a head cover 61 fixed to the head frame 50 is formed with cutouts 62 for holding the rear ends of the armatures 55 and also formed with lugs 63 for guiding both sides of an intermediate portion of each armature 55. Also held by the head cover 61 are a plate spring 64 which presses the rear end of each armature 55 against an end face of the circumferential wall 51*a* of the yoke 50, and a damper 65 which abuts the back of each armature 55.

Under the above construction, upon energization of an electromagnetic coil 52, the corresponding armature 55 is attracted by the core 53, causing the needle 57 to strike paper on the platen. Then, the armature returns to its home position by virtue of the urging force of the needle 57 which returns to its home position under a reaction force induced by the said collision and the restoring force of the spring 56. The returning movement of the armature 55 is stopped by the damper 65.

Since there is a recent demand for the reduction of size even in a dot printer head having an increased number of needles 57 to enhance the dot density, the increase in sectional area of the core 53 and the circumferential wall 51*a* of the yoke 51 is limited even when it is intended to improve the flow of magnetic flux. More particularly, in order to set the stroke of the needle 57 at a certain length or longer, it is necessary to ensure a certain distance for the armature 55 from the portion opposed to the core 53 up to the front end on the needle 57 side, and thus a limit is encountered in reducing the arrangement diameter of the cores 53. Therefore, as shown in phantom line in FIG. 15, in order to enlarge the sectional area of the cores 53 it is required to lengthen the cores radially outwards. Consequently, if the outside diameter of the yoke 51 is limited, the sectional area of the circumferential wall 51*a* becomes smaller and magnetic saturation is created between the circumferential wall 51*a* and the armature 55, resulting in that the magnetic efficiency is deteriorated and the energy consumed increases.

OBJECT AND SUMMARY OF THE INVENTION

It is the first object of the present invention to enlarge the sectional area of each core without enlarging the yoke diameter.

It is the second object of the present invention to reduce the entire size.

It is the third object of the present invention to enlarge the sectional area of a magnetic circuit.

It is the fourth object of the present invention to decrease the magnetic resistance of the magnetic circuit and thereby reduce the power consumption.

According to the present invention, a plurality of cores for holding electromagnetic coils are erected annularly on one side of a polygonal plate-like yoke, and needles are connected to inner ends of plural armatures opposed to end faces of the cores. Further, there is provided a guide member for arranging those needles in order and holding them slidably, and a side magnetic path is formed between adjacent such armatures. Additionally, a polygonal side magnetic path plate which holds the armatures for rising and falling motions is provided, and support rods which are magnetically coupled to the corners of the said side magnetic path plate are erected on the corners of the yoke. Consequently, upon energization of an electromagnetic coil, magnetic flux flows through the corresponding core and armature, side magnetic paths, adjacent armatures and the cores opposed thereto, and yoke, and also flows through the cores, armatures, side magnetic path plate, support rods and yoke. Since the support rods which form a magnetic circuit between the side magnetic path plate and the yoke are formed at the corners of the yoke, it is not necessary that a circumferential wall for magnetic coupling between the yoke and the side magnetic path plate be formed in the arranged direction of the cores, whereby while the yoke diameter is restricted, the sectional area of each core and that of the magnetic circuit formed between the yoke and the side magnetic path plate can be enlarged.

BRIEF DESCRIPTION OF THE DRAWINGS

FIG. 8(*b*) is a partial side view in vertical section showing a relation between the core on the yoke and the armature;

FIG. 15(i b) is a side view in vertical section thereof.

DETAILED DESCRIPTION OF PREFERRED EMBODIMENTS

An embodiment of the present invention will be described hereinunder with reference to FIGS. 1 to 12.

Figure 1:
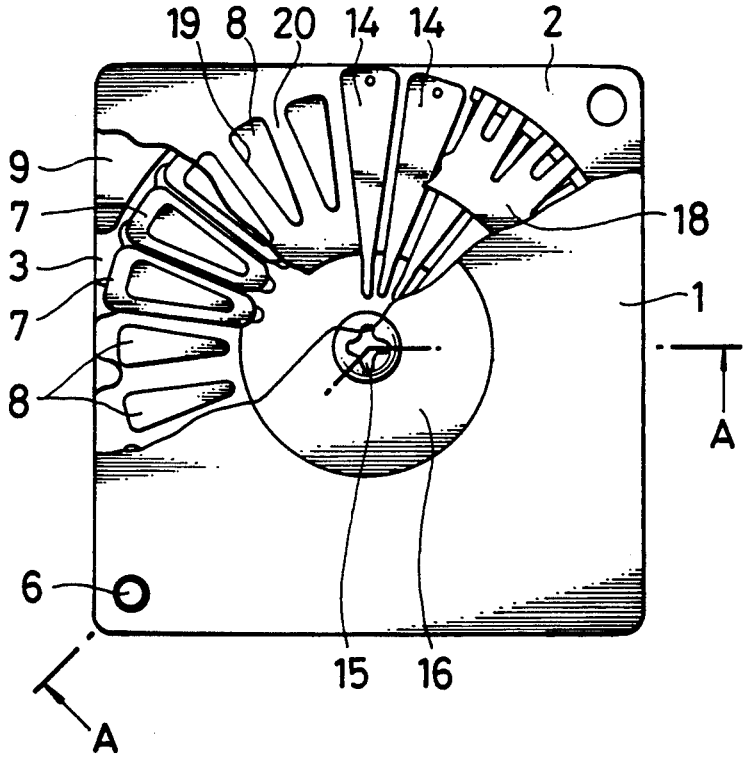
FIG. 1 is a partially cut-away plan view.
Figure 2:
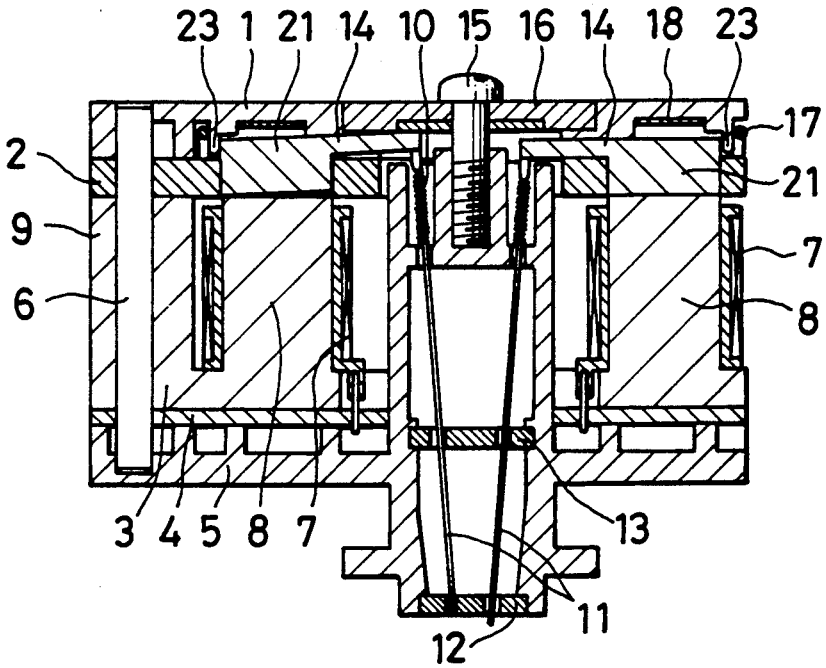
FIG. 2 is a side view in vertical section taken on line A—A in FIG. 1.
Figure 3:
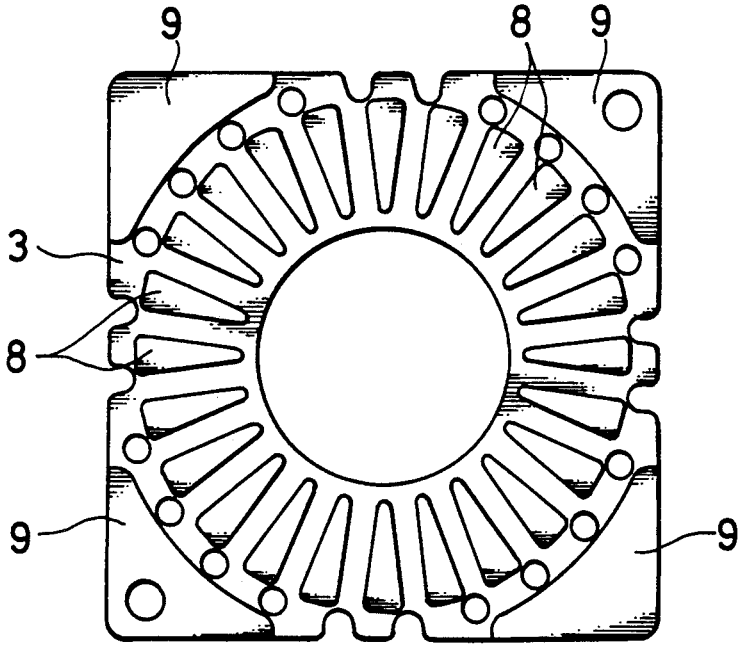
FIG. 3 is a plan view showing a state in which cores and support rod portions are formed on one side of a yoke.
Figure 4:
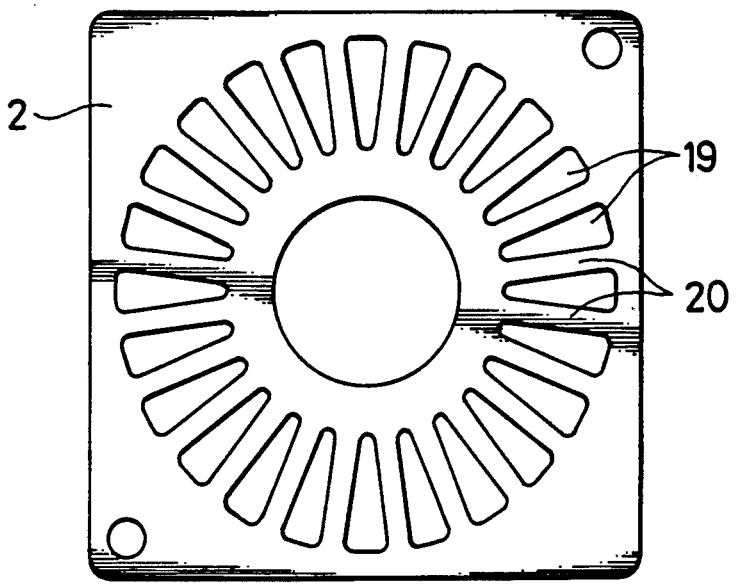
FIG. 4 is a plan view of a side magnetic path plate.
Figure 6:
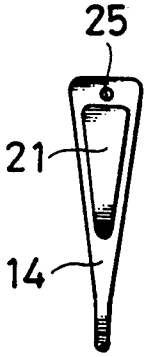
FIG. 6 is a plan view of an armature.
Figure 7:
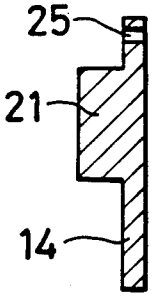
FIG. 7 is a side view in vertical section of the armature.

FIG. 1 is a partially cut-away plan view and FIG. 2 is a side view in vertical section taken on line A—A in FIG. 1. Successively from the above, a head cover 1 formed of a synthetic resin, a side magnetic path plate 2 and a yoke 3 both formed of a magnetic material, a PC plate 4 and a guide member 5 formed of a synthetic resin are coupled together in a laminated state through pins 6 formed of a magnetic material. The yoke 3 is in the form of a square plate and on one side thereof are integrally formed annularly a plurality of cores 8 which hold electromagnetic coils 7. And on the four corners of the yoke 3 there are integrally formed support rod portions 9 which are in contact with the corners of the side magnetic path plate 2 (see FIG. 3). The pins 6 extend through two support rod portions 9 which are opposed to each other in a diagonal direction. A plurality of needles 11 which are biased with needle springs 10 are slidably held by guide chips 12 and 13 fixed to the guide member 5. Further, a plurality of armatures 14 are mounted to the side magnetic path plate 2 so that they can rise and fall in opposed relation to the cores 8. Caps at the rear ends of the needles 11 are in abutment with the inner ends of the armatures 14. Moreover, a disc-like armature stopper 16 fixed to the center of the guide member 5 with a bolt 15 is fitted in the head cover 1. The armature stopper 16 is formed of aluminum, and to the inner surface thereof rubber is fusion-bonded with which the armatures 14 are brought into abutment. Further, a petal-like plate spring 18 which presses the rear ends of the armatures 14 against the side magnetic path plate 2 is held on the inner surface of the head cover 1. As shown in FIGS. 2, 6 and 7, moreover, a projecting portion 21 projecting toward the core 8 is formed at the central part of each armature 14. Additionally, as shown in FIGS. 1 and 4, in the side magnetic path plate 2 there are formed openings 19 in which are fitted the projecting portions 21 of the armatures 14, and also formed are side magnetic paths 20 each forming a magnetic circuit between adjacent armatures 8.

Figure 5:
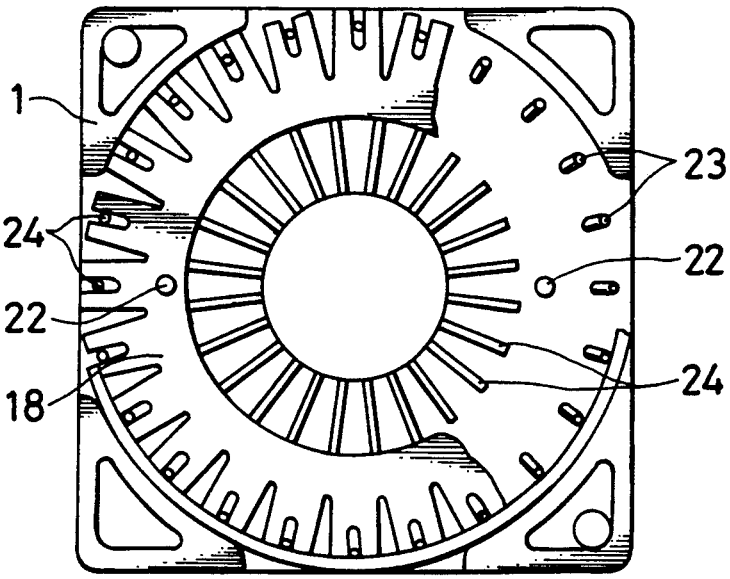
FIG. 5 is a plan view showing an inner surface of a head cover.

FIG. 5 is a plan view showing the inner surface of the head cover 1. On the inner surface of the head cover 1 there are integrally formed bosses 22 extending through the plate spring 18 to position and fix the latter, a plurality of pins 23 on which is fitted the inner peripheral surface of the ring 17 and which hold the outer peripheral portion of the plate spring 18 displaceably, and a plurality of ribs 24 for guiding both side faces of the armatures 14. The pins 23 are also fitted in small holes 25 (see FIGS. 6 and 7) formed in the rear ends of the armatures 14.

Figure 9:
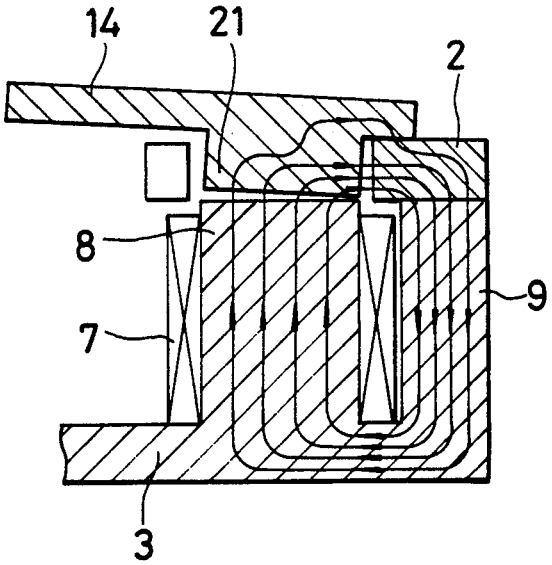
FIG. 9 is a partial side view in vertical section showing the flow of magnetic flux upon energization of a specific electromagnetic coil.
Figure 10:
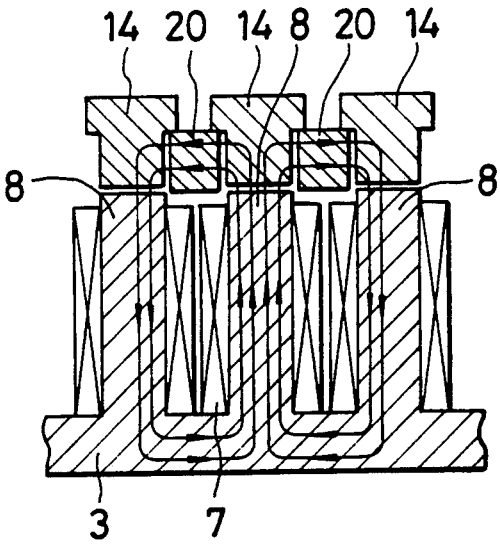
FIG. 10 is a front view in vertical section thereof.

In such construction, when a specific electromagnetic coil 7 is energized, the corresponding armature 14 is attracted by the core 8 while being turned around the portion thereof in abutment with the side magnetic path plate 2 by the pressure of the ring 17, thus causing the needle 11 to strike the paper on the platen. Then, the armature 14 returns to its home position while being pushed by both a reaction force induced in the said collision of the needle with the paper and the restoring force of the spring 18. The returned position is defined by the armature stopper 16. At this time, as shown in FIG. 10, magnetic flux flows through the core 8 which holds the energized electromagnetic coil 7, the armature 14 opposed to the core 8, side magnetic paths 20 in the side magnetic path plate 2, the adjacent armatures 14 on both sides, the cores 8 opposed to the adjacent armatures, and the yoke 3 in this order. At the same time, as shown in FIG. 9, magnetic flux flows successively through the cores 8, armatures 14, side magnetic path plate 2, support rod portions 9 and yoke 3.

A comparison is here made between the portion where there is a side wall of the yoke 3 and the portion where there is not. The magnetic path length of the magnetic flux flowing through the side magnetic path in the side magnetic path plate 2 is larger at the side wall-free portion, but there arises no problem because the side magnetic path is of a ferromagnetic material and so the magnetic resistance is very low. Between the side wall-present and -free portions there is a difference of whether there is leakage flux from the side wall to the cores 8. According to experiments, however, the ratio of such leakage flux to the main magnetic flux is as small as 5% or less and thus the actual printing is little influenced thereby.

Figure 11:
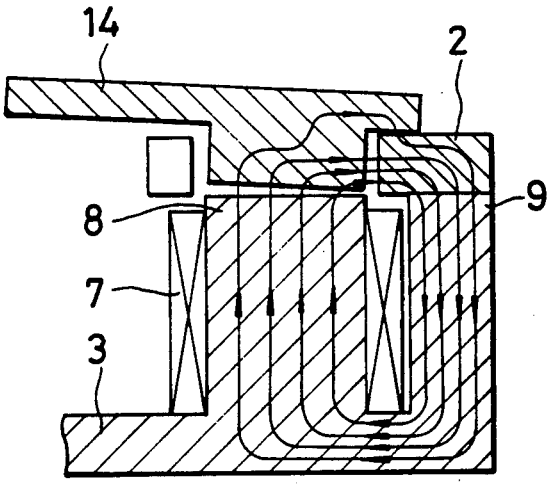
FIG. 11 is a partial side view in vertical section showing the flow of magnetic flux upon energization of all electromagnetic coils.
Figure 12:
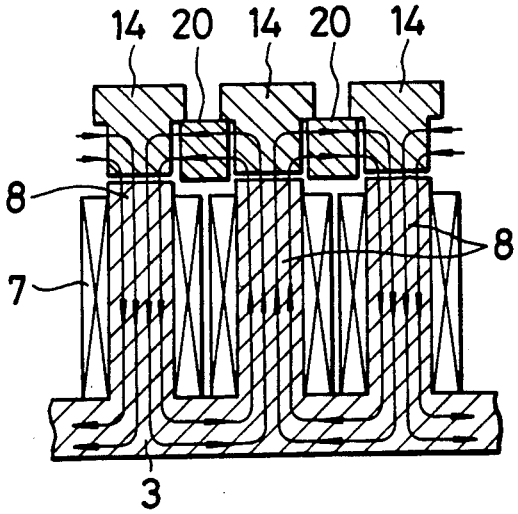
FIG. 12 is a front view in vertical section thereof.

By connecting the electromagnetic coils 7 to a power source in such a manner that adjacent coils 7 are opposite in polarity to each other, adjacent cores 8 become opposite to each other in the direction of magnetic flux, whereby even when all the electromagnetic coils 7 are energized, magnetic flux can flow successively through each of the cores 8, the armature 14 opposed thereto, side magnetic paths 20 in the side magnetic path plate 2, the adjacent armatures 14 on both sides, the cores 8 opposed to those armatures 14, and the yoke 3, as shown in FIG. 12. At the same time, as shown in FIG. 11, it is possible to let magnetic flux flow through cores 8, armatures 14, side magnetic path plate 2, support rod portions 9 and yoke 3 in this order. Thus, even when all the electromagnetic coils 7 are energized, it is not that all the magnetic fluxes pass through the support rod portions 9, but a portion thereof flows through the magnetic circuit formed by adjacent armatures 14 and cores 8, so the support rod portions 9 will never assume the state of magnetic saturation.

Figure 8A:
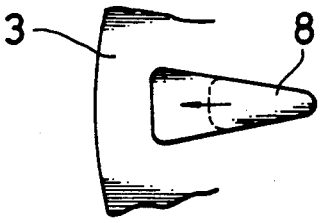
FIG. 8(*a*) is a plan view showing part of the yoke.
Figure 8B:
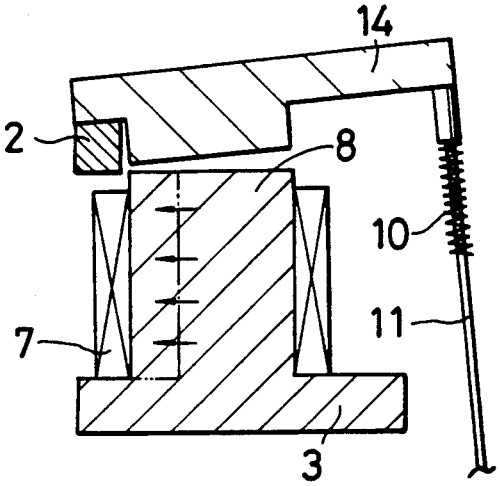

Since the support rod portions 9 forming a magnetic circuit between the side magnetic path plate 2 and the yoke 3 are formed at the corners of the yoke 3, it is not necessary that a circumferential wall for magnetic coupling between the yoke 3 and the side magnetic path plate 2 be formed in the arranged direction of the cores 8. Consequently, as shown in FIG. 8, it is possible to enlarge each core 8 in the arrowed direction as indicated by a solid line from the state thereof indicated by a phantom line to thereby enlarge its sectional area while restricting the diameter of the yoke 3. Besides, since the cores 8 are arranged annularly and the yoke 3 is square, it is possible to form the support rod portions 9 of a large sectional area at the four corners of the yoke 3, and a magnetic circuit between the yoke 3 and the side magnetic path plate 2 by those support rod portions 9. Consequently, it is possible to prevent magnetic saturation and also possible to increase the permeance between the armatures 14 and the cores 8, whereby it is made possible to diminish the magnetic resistance of the magnetic circuit, improve the magnetic efficiency and decrease the power consumption required for energizing the electromagnetic coils 7. Further, the size of the yoke 3 can be reduced and hence it is possible to reduce the size of all the components coupled to the yoke 3, i.e., the side magnetic path plate 2, head cover 1, guide member 5, PC plate 4.

Although this effect is exhibited most outstandingly in the case of a square yoke, even when there is used a polygonal yoke other than a square yoke, the same purpose can be attained by forming the support rod portions 9 at the corners of the yoke. This state will be explained below with reference to FIG. 13.

Figure 13A:
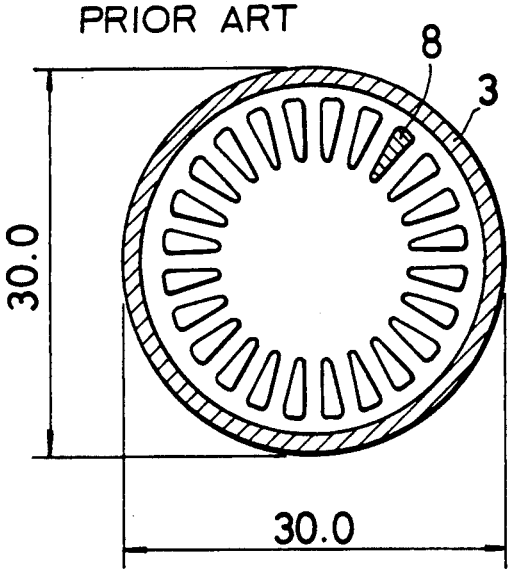
FIG. 13(a) PRIOR ART
FIGS. 13(*a*), (*b*) and (*c*) are sectional views showing the ratio of the sectional area of the yoke to that of cores at different external shapes.
Figure 13B:
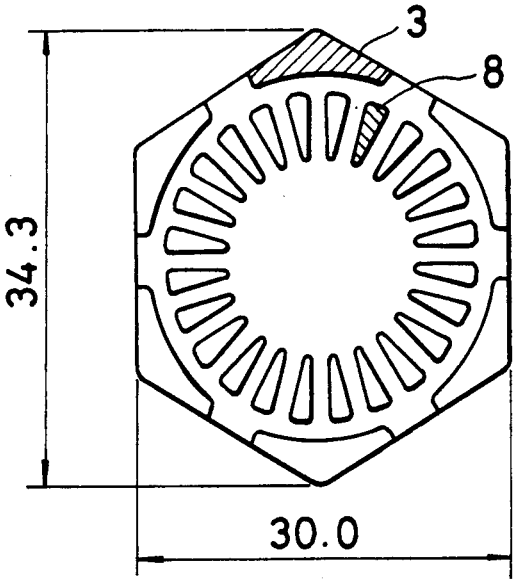
Figure 13C:
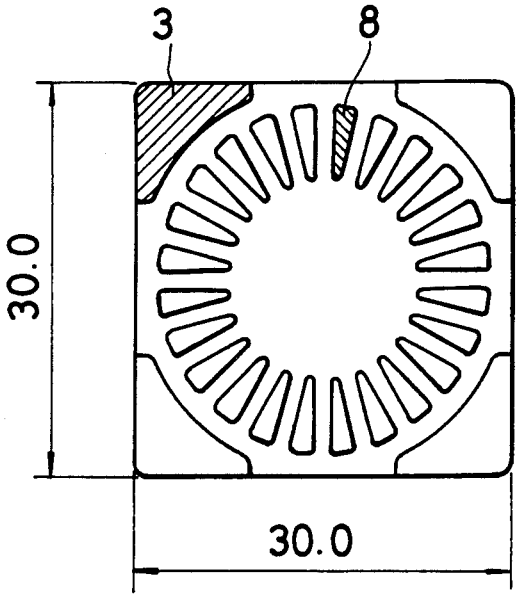
Figure 14:
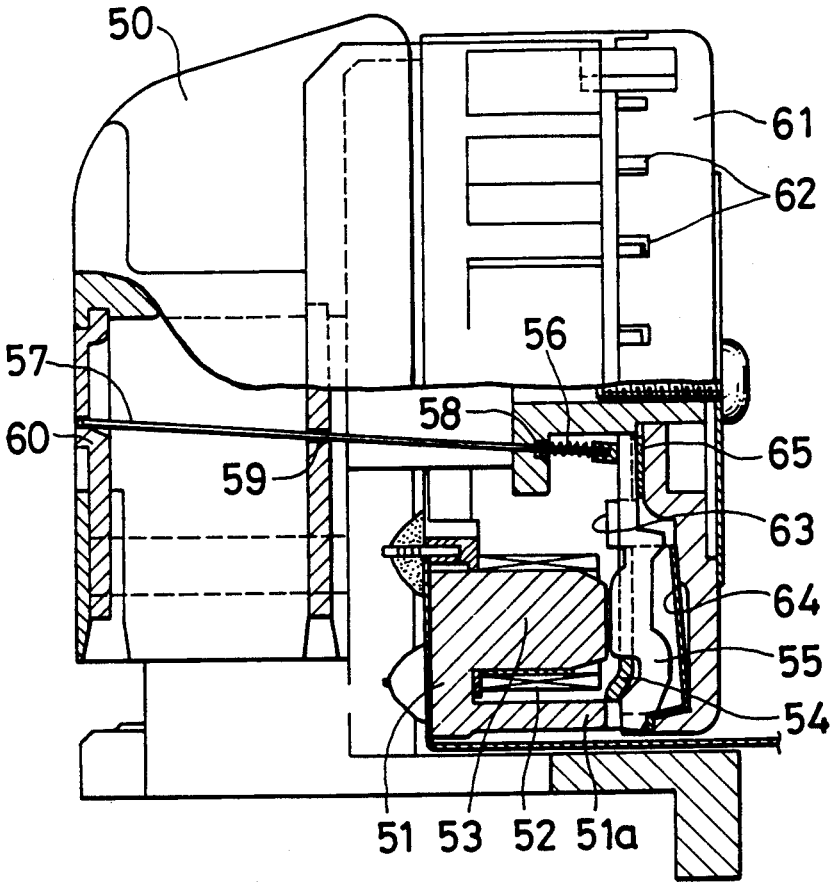
FIG. 14 (PRIOR ART)
FIG. 14 is a partially cut-away side view showing a conventional example.
Figure 15A:
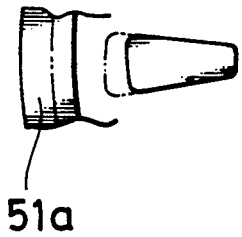
FIG. 15(a) (PRIOR ART)
FIG. 15(*a*) is a plan view showing part of the yoke.
Figure 15B:
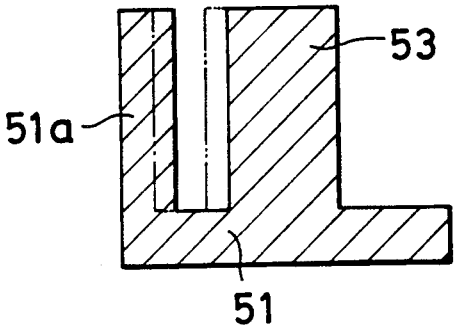
FIG. 15(b) (PRIOR ART)

FIG. 13(*a*) shows an example in which there is used a yoke 3 having a circular external form, and the total sectional area of cores 8 and the sectional area of the side wall of the yoke 3 are equal to each other. According to a concrete example, in the case where the size of the external shape is 30.0 mm, the sectional area of the side wall of the yoke 3 is 126 $mm^2$.

FIG. 13(*b*) shows an example in which there is used a yoke 3 having a hexagonal external shape, and the sectional area of the side wall of the yoke 3 is 144 $mm^2$. Thus, the sectional area can be taken 1.14 times as large as the circular yoke.

FIG. 13(*c*) shows an example in which there is used a yoke 3 having a square external shape, and the sectional area of the side wall of the yoke 3 is 180 $mm^2$. Thus, the sectional area can be taken 1.43 times as large as the circular yoke. Now it is seen that the yoke 3 having a square external shape is most effective from the standpoint of space.

Since the present invention is constructed as above, when an electromagnetic coil is energized, magnetic flux flows through the corresponding core and armature, side magnetic paths, adjacent armatures, cores opposed to the armatures, and yoke. At the same time, magnetic flux can flow through the cores, armatures, side magnetic path plate, support rod portions and yoke. Moreover, since the support rod portions forming a magnetic circuit between the side magnetic path plate and the yoke are formed at the corners of the yoke, it is not necessary that a circumferential wall for magnetic coupling between the yoke and the side magnetic path plate be formed in the arranged direction of the cores. Consequently, while restricting the yoke diameter, it is possible to enlarge the sectional area of the cores and that of the magnetic circuit formed between the yoke and the side magnetic path plate. Therefore, it is possible to prevent magnetic saturation, diminish the magnetic resistance of the magnetic circuit and decrease the power consumption required for energizing the electromagnetic coils. Further, it is possible to reduce the diameter of the yoke and thereby reduce the size of the whole of the dot printer head.

What is claimed is:

1. A dot printer head comprising:

a polygonal plate-like yoke having corners and a circumferential wall at each corner, each of said circumferential walls being separated from one another by a wall-free portion;

a plurality of cores erected annularly on one side of said yoke;

a plurality of electromagnetic coils wound round said cores;

a plurality of armatures opposed to end faces of said cores;

a plurality of needles connected to inner ends of said armatures;

a guide member for arranging said needles in order and holding them slidably; and a polygonal, side magnetic path plate having side magnetic paths each formed between adjacent said armatures, said side magnetic path plate holding said armatures so as to permit the armatures to rise and fall;

wherein the circumferential wall portions at the corners of said yoke are coupled magnetically to respective corners of said side magnetic path plate.

2. A dot printer head according to claim 1, wherein said side magnetic path plate has a square shape.

3. A dot printer head according to claim 1, wherein adjacent said electromagnetic coils are connected to a power source in polarities opposite to each other.

* * * * *